United States Patent [19]

Hasegawa et al.

[11] Patent Number: 4,491,108

[45] Date of Patent: Jan. 1, 1985

[54] IDLING RPM FEEDBACK CONTROL METHOD FOR INTERNAL COMBUSTION ENGINES

[75] Inventors: Shumpei Hasegawa, Niiza; Takashi Koumura, Saitama; Toshiyuki Mieno, Wako, all of Japan

[73] Assignee: Honda Motor Co., Ltd., Tokyo, Japan

[21] Appl. No.: 484,157

[22] Filed: Apr. 12, 1983

[30] Foreign Application Priority Data

Apr. 20, 1982 [JP] Japan ..... 57-66042

[51] Int. Cl.[3] ..... F02D 9/02; F02M 3/00

[52] U.S. Cl. ..... 123/339; 123/585

[58] Field of Search ..... 123/339, 585, 389, 352, 123/360, 370, 386, 351; 73/364

[56] References Cited

U.S. PATENT DOCUMENTS

| | | | |
|---|---|---|---|
| 4,289,100 | 9/1981 | Kinuyawa et al. | 123/585 |
| 4,345,557 | 7/1982 | Ikeura | 123/339 |
| 4,368,707 | 1/1983 | Leshner et al. | 123/585 |
| 4,375,208 | 3/1983 | Furuhashi et al. | 123/585 |
| 4,378,766 | 4/1983 | Yamazoe et al. | 123/585 |

*Primary Examiner*—Raymond A. Nelli

*Attorney, Agent, or Firm*—Arthur L. Lessler

[57] ABSTRACT

An idling rpm feedback control method comprises controlling the quantity of supplementary air being supplied to an internal combustion engine equipped with at least one equipment which creates a load acting on the engine and includes at least one electrical device, in a feedback manner responsive to the difference between actual engine rpm and desired idling rpm during idling of the engine. The method also comprising varying the quantity of fuel being supplied to the engine in response to detected values of the total quantity of intake air inclusive of supplementary air at each predetermined rotational angle of the engine, so as to maintain the air-fuel ratio of a mixture being supplied to the engine at a desired value. When a transition is detected in the operative state of the load-creating equipment, the supplementary air quantity is varied by a predetermined amount corresponding to the magnitude of load of the load-creating equipment, and the fuel quantity is varied by a predetermined amount a predetermined number of times corresponding to the magnitude of the load-creating equipment. Preferably, the above variation of the fuel quantity is initiated after the lapse of a predetermined period of time from the start of the above variation of the supplementary air quantity.

12 Claims, 10 Drawing Figures

INTERNAL COMBUSTION ENGINE
ELECTRONIC CONTROL UNIT
OTHER SENSORS
RPM SENSOR
TEMP. SENSOR
PRESS. SENSOR
THROTTLE SENSOR
#1 ELEC. DEVICE
#2 ELEC. DEVICE
#3 ELEC. DEVICE
1
2
3
4
5
6
6a
6b
7
8
8a
9
10
11
12
13
14
15
16
17
18
19
20
21
22
23
24
25
26
26a
27
28
29
30
30a
30b
31
31a
31b

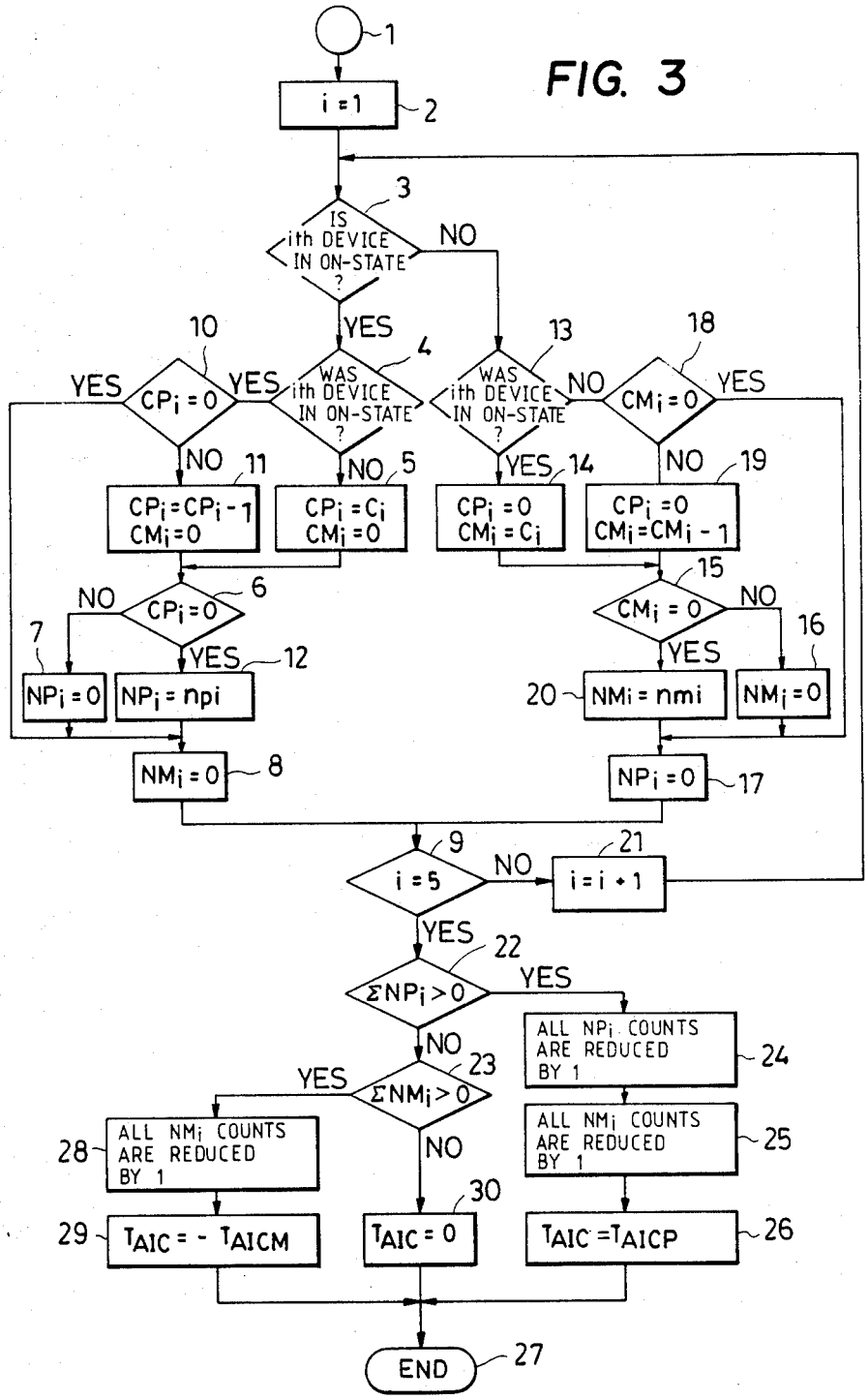
FIG. 3
1
i = 1
2
3
IS ith DEVICE IN ON-STATE ?
NO
YES
10
CPi = 0
YES
4
WAS ith DEVICE IN ON-STATE ?
13
WAS ith DEVICE IN ON-STATE ?
NO
18
CMi = 0
YES
NO
11
CPi = CPi - 1
CMi = 0
NO
5
CPi = Ci
CMi = 0
YES
14
CPi = 0
CMi = Ci
NO
19
CPi = 0
CMi = CMi - 1
NO
6
CPi = 0
7
NPi = 0
YES
12
NPi = npi
15
CMi = 0
NO
16
NMi = 0
YES
20
NMi = nmi
NMi = 0
8
NPi = 0
17
9
i = 5
NO
21
i = i + 1
YES
22
ΣNPi > 0
YES
ALL NPi COUNTS ARE REDUCED BY 1
24
NO
23
ΣNMi > 0
YES
28
ALL NMi COUNTS ARE REDUCED BY 1
NO
ALL NMi COUNTS ARE REDUCED BY 1
25
29
TAIC = - TAICM
30
TAIC = 0
TAIC = TAICP
26
END
27

IDLING RPM FEEDBACK CONTROL METHOD FOR INTERNAL COMBUSTION ENGINES

BACKGROUND OF THE INVENTION

This invention relates to an idling rpm feedback control method for internal combustion engines, which can eliminate a time lag in the control of the supply of fuel to the engine when a sudden change occurs in the quantity of supplementary air being supplied to the engine.

An internal combustion engine can easily stall due to a drop in the engine speed when the engine is operated in an idling condition at a low temperature of the engine cooling water or when the engine is heavily loaded by head lamps, air conditioner, etc. in a vehicle equipped with the engine. Also, on such occasions, unburnt ingredients such as CO and HC are emitted from the engine, badly affecting the emission characteristics and fuel consumption.

To eliminate such disadvantages, an idling rpm feedback control method has been proposed, e.g. by Japanese Patent Provisional Publication (Kokai) No. 55-98628 or U.S. Pat. No. 4,289,100 issued on Sept. 15, 1981 in the names of Kinugawa et al., which comprises setting desired idling rpm in dependence upon load on the engine, detecting the difference between actual engine rpm and desired idling rpm, and supplying supplementary air to the engine in a quantity corresponding to the detected difference so as to minimize the same difference, to thereby control the engine rpm to the desired idling rpm.

It has also been proposed by Japanese Patent provisional Publication (Kokai) No. 58-197449, or the above U.S. Pat. No. 4,289,100 to detect on- and off-states of electrical devices or equipments such as the headlamps, the brake lamp, the radiator cooling fan, and mechanical devices or equipments directly driven by the engine, such as the air conditioner and the automatic transmission during the above-mentioned idling rpm feedback control, and upon detecting a transition in the operative state of such an equipment, varying the quantity of supplementary air by a predetermined amount corresponding to the magnitude of the electrical load or the mechanical load applied by the device concerned, thereby minimizing lag of the engine rpm control.

According to this proposed method, when a control valve for controlling the supplementary air quantity is opened upon detection of a transition to an on-state of one of the electrical devices or the mechanical devices, and for a period of time corresponding to a required increase in the supplementary air quantity, there is a time lag between the opening of the control valve and the arrival of the increased supplementary air to the engine cylinders. Such time lag is determined by the configuration and size of the supplementary air passage extending from the control valve to the engine cylinders.

Further, an electronic fuel supply control system is already known which detects the total quantity of intake air inclusive of supplementary air being supplied to the engine and controls the fuel supply quantity in response to the resulting detected value, so as to achieve a desired air-fuel ratio of the mixture. However, even with this proposal, due to a lag in the detection of a change in the intake air quantity, which is attributed to the characteristics of the intake air quantity sensor, the mixture becomes lean instantaneously when there is a rapid increase in the supplementary air quantity, causing engine stall or hunting of the engine rotation, whereas the mixture becomes too rich when there is a rapid decrease in the supplementary air quantity, not only deteriorating the emission characteristics but also causing hunting of the engine rotation to create discomfort to the driver.

SUMMARY OF THE INVENTION

It is an object of the invention to provide an idling rpm feedback control method for an internal combustion engine, which provides for compensation for a lag in the detection of a change in the supplementary air quantity corresponding to a change in the engine load, so as to maintain the air-fuel ratio of an air-fuel mixture being supplied to the engine at a desired value, thereby avoiding engine stall and hunting of the engine rotation even when a rapid change occurs in the supplementary air quantity.

It is a further object of the invention to provide an idling rpm feedback control method for an internal combustion engine, according to which the timing of initiation of correction of the fuel quantity for compensation for the detecting lag of the intake air quantity is set in conjunction with the travel lag of the supplementary air to the engine cylinders, thereby achieving accurate control of the fuel quantity as well as stable control of the engine rpm.

The present invention provides a method for controlling the idling rpm of an internal combustion engine including an intake passage, a throttle valve arranged in the intake passage, an air passage having one end communicating with the intake passage at a location downstream of the throttle valve and another end with the atmosphere, respectively, a control valve arranged in the air passage for metering the quantity of supplementary air being supplied to the engine through the air passage, and at least one equipment disposed to create a load acting on the engine. The method comprises controlling in a feedback manner the control valve in response to the difference between actual engine rpm and desired idling rpm during idling of the engine, detecting the total quantity of intake air inclusive of the supplementary air at each predetermined rotational angle of the engine, and varying the quantity of fuel being supplied to the engine in response to the resulting detected value of the intake air quantity, so as to maintain the air-fuel ratio of an air-fuel mixture being supplied to said engine at a desired value. The method according to the present invention is characterized by comprising the further steps of: (a) detecting the operative state of the load-creating equipment; and (b) upon detection of a transition in the operative state of the load-creating equipment, varying the supplementary air quantity through the control valve, in response to the magnitude of load on the engine, applied by the equipment, in a manner such that (i) when the equipment is rendered operative, the fuel quantity is increased by a first predetermined amount at the above each predetermined rotational angle of the engine a first predetermined number of times, and (ii) when the equipment is rendered inoperative, the fuel quantity is decreased by a second predetermined amount at the above each predetermined rotational angle of the engine a second predetermined number of times.

Preferably, the increase or decrease of the fuel quantity by the above first or second predetermined amount is initiated after the lapse of a predetermined period of time from the start of the above variation of the supplementary air quantity responsive to a transition in the operative state of the load-creating equipment. The above first and second predetermined numbers of times are determined in dependence on the magnitude of load of the load-creating equipment acting on the engine.

If a plurality of load-creating equipments are provided for applying load to the engine, as many air passages are provided in each of which is arranged a supplementary air quantity control valve. The operative state of each of the load-creating equipments is detected, and when a transition is detected in the operative state of one of the equipments, a corresponding one of the control valves is controlled to vary the supplementary air quantity in the aforementioned manner, and the fuel quantity is correspondingly varied in the aforementioned manner. If there is a concurrence of a state in which one of the control valves is supplying an increased quantity of supplementary air to the engine and a state in which another one of the control valves is supplying a decreased quantity of supplementary air to the engine and accordingly there is a concurrence of contradictory requirements of increase of the fuel quantity by the first predetermined amount and decrease of same by the second predetermined amount, the increase by the first predetermined amount is preferentially carried out.

Further, in the event that the supply of supplementary air is effected through a plurality of control valves at the same time and accordingly there is an apparent requirement of a plurality of concurrent increases of the fuel quantity by amounts each amounting to the first predetermined amount, the total increasing fuel amount is limited to only the first predetermined amount. Similarly, even in the event that the fuel quantity should be decreased by amounts each amounting to the second predetermined amounts, the total decreasing fuel amount is limited to only the second predetermined amount.

The above and other objects, features and advantages of the invention will be more apparent from the ensuing detailed description taken in conjunction with the accompanying drawings.

BRIEF DESCRIPTION OF THE DRAWINGS

FIG. 3 is a flow chart showing a routine for carrying out the method of the invention, which is executed in the electronic control unit (ECU) in FIG. 1.

DETAILED DESCRIPTION

The method of the invention will be described in detail with reference to the accompanying drawings.

Figure 1:
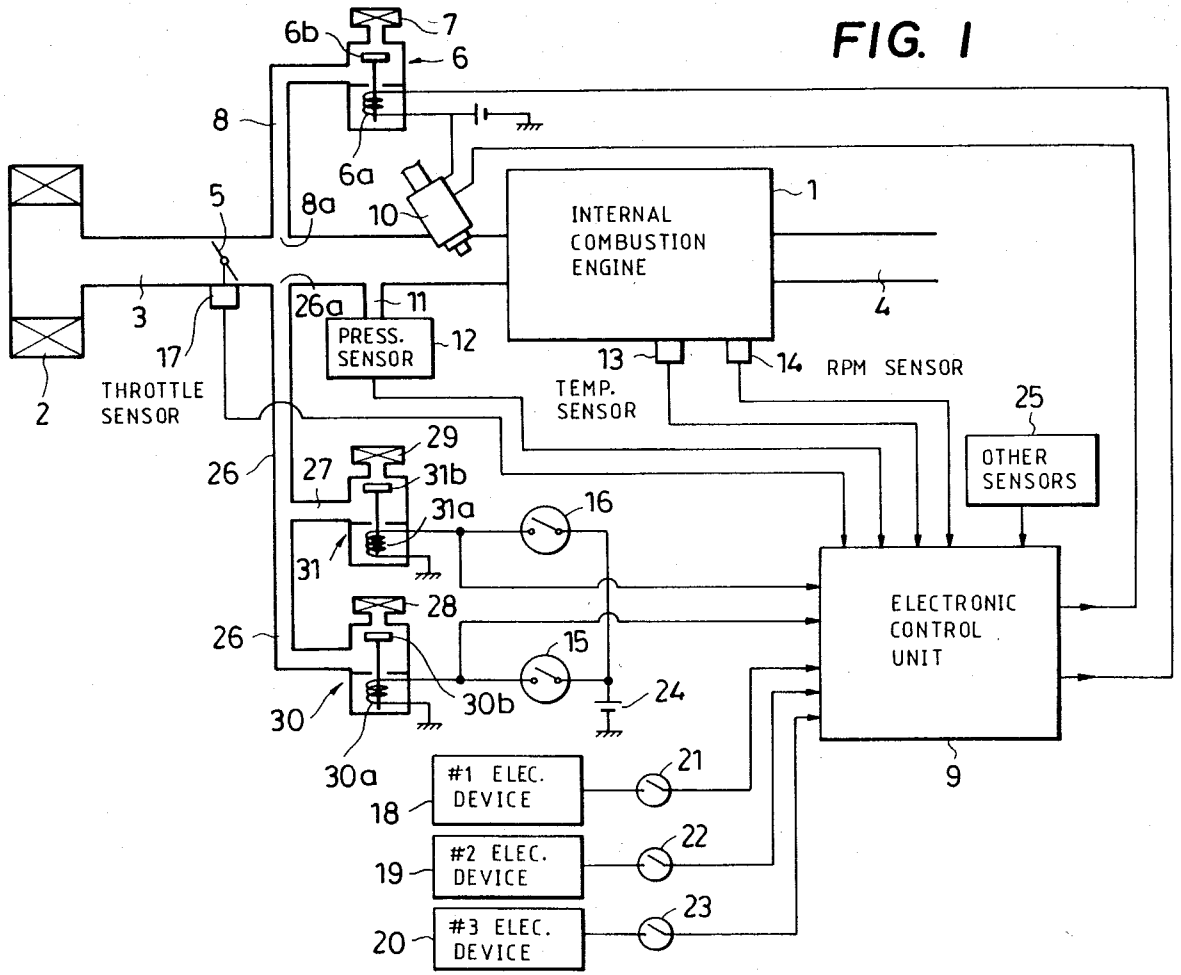
FIG. 1 is a block diagram illustrating the whole arrangement of an idling rpm feedback control system to which is applicable the method of the invention.

Referring first to FIG. 1, an idling rpm feedback control system is schematically illustrated, to which is applicable the method of the invention. In FIG. 1, reference numeral 1 designates an internal combustion engine which may be a four-cylinder type, and to which are connected an intake pipe 3 with an air cleaner mounted at its open end and an exhaust pipe 4, at an intake side and at an exhaust side of the engine 1, respectively. A throttle valve 5 is arranged within the intake pipe 3, and a first air passage 8 and a second air passage 26 open at their open ends 8*a* and 26*a* in the intake pipe 3 at locations downstream of the throttle valve 5 and communicate at the other ends with the atmosphere. An air cleaner 7 is mounted at the other end of the first air passage 8. Arranged across the first air passage 8 is a first supplementary air quantity control valve (hereinafter merely called "the first control valve") 6 which controls the quantity of supplementary air being supplied to the engine 1 through the first air passage 8. This first control valve 6 is a normally closed type and comprises a solenoid 6*a* and a valve body 6*b* disposed to open the first air passage 8 when the solenoid 6*a* is energized. The solenoid 6*a* is electrically connected to an electronic control unit (hereinafter called "the ECU") 9.

A third air passage 27 branches off from the second air passage 26, both of which have their atmosphere-opening ends provided with air cleaners 28 and 29. Second and third supplementary air control valves 30 and 31 are arranged, respectively, across a portion of the second air passage 26 between the junction of the same passage 26 with the third air passage 27 and its atmosphere-opening end and across the third air passage 27. The control valves 30, 31 are both a normally closed type and each comprise a solenoid 30*a*, 31*a*, and a valve body 30*b*, 31*b* disposed to open the corresponding air passage when the solenoid 30*a*, 31*a* is energized. The solenoids 30*a*, 30*b* have their one ends grounded and the other ends connected to a direct current power source 24, respectively, by way of switches 15 and 16, and directly to the ECU 9.

A fuel injection valve 10 is arranged in a manner projected into the interior of the intake pipe 3 at a location between the engine 1 and the open ends 8*a* and 26*a* of the first and second air passages 8, 26 opening in the intake pipe 3. The injection valve 10 is connected to a fuel pump, not shown, and also electrically connected to the ECU 9.

A throttle valve opening sensor 17 is mounted on the throttle valve 5, and an absolute pressure sensor 12 communicates with the intake pipe through a conduit 11 at a location downstream of the open ends 8*a*, 26*a* of the first and second air passages 8, 26, while an engaging cooling water temperature sensor 13 and an engine rpm sensor 14 are both mounted on the body of the engine 1. All the sensors and other sensors 25 for detecting other parameters of the operating conditions of the engine 1 are electrically connected to the ECU 9. The above absolute pressure sensor 12 is a known type which is formed, e.g. of a bellows having a vacuum interior and a differential transformer, neither of which is shown. The bellows is coupled to the movable iron core of the differential transformer such that the position of the movable iron core is determined by the volume of the bellows variable in response to the pressure in the intake pipe (absolute pressure), to generate an output voltage corresponding to the position of the core. This output voltage is supplied to the ECU 9 as an intake pipe absolute pressure signal.

In FIG. 1, reference numerals 18, 19 and 20 designate electrical devices such as head lamps, a brake lamp and a radiator cooling fan, which are electrically connected to the ECU 9 by way of respective switches 21, 22 and 23. Reference numeral 25 denotes other engine parameter sensors such as an atmospheric pressure sensor, which are also electrically connected to the ECU 9.

The idling rpm feedback control system constructed as above operates as follows: The switch 15 is disposed for turning on and off in unison with a power switch, not shown, for actuating the air conditioner, not shown, and therefore when closed, its closing signal is supplied to the ECU as a signal indicative of an on-state of the air conditioner in the ECU 9. The closing of the switch 15 causes energization of the solenoid 30*a* of the second control valve 30 to open the valve body 30*b* for supplying the engine 1 with a predetermined quantity of supplementary air corresponding to an increase in the engine load caused by the operation of the air conditioner.

The switch 16 is mounted, e.g. on a shift lever, not shown, if the present system is installed in an internal combustion engine equipped with an automatic transmission, and it is closed when the shift lever is moved to an engaging position of the automatic transmission, and supplies an on-state signal indicative of the engagement of the automatic transmission (hereinafter called "the D-range signal") to the ECU 9, and the closing of the switch 16 causes energization of the solenoid 31*a* of the third control valve 31 to open the valve body 31*b* for supplying the engine 1 with a predetermined quantity of supplementary air corresponding to increased engine load caused by the operation of the automatic transmission.

Thus, accurate control of the engine rpm can be achieved with ease due to the provision of the second and third control valves for supplying supplementary air to the engine 1 in quantities corresponding to mechanical loads, which are relatively large, applied by mechanical equipments directly driven by the engine, such as the air conditioner and the automatic transmission.

On the other hand, the first control valve 6 is used for feedback control of the supplementary air quantity wherein the same quantity is varied so as to maintain the engine rpm at desired idling rpm. Also, it is used for increasing the supplementary air by a predetermined amount corresponding to electrical load on the engine, which is relatively small, when an electrical equipment such as headlamps, a brake lamp and a radiator cooling fan is switched on.

The ECU 9 determines the operating conditions and loaded conditions of the engine 1 in dependence on values of signals indicative of engine operating condition parameters supplied from the throttle valve opening sensor 17, the absolute pressure sensor 12, the engine cooling water temperature sensor 13, the engine rpm sensor 14, and the other engine operation parameter sensors 25, signals indicative of electrical loads from the electrical devices 18, 19, 20, an on-state signal from the air conditioner, and the D-range signal from the automatic transmission. The ECU 9 calculates a desired quantity of fuel to be supplied to the engine 1, that is, a desired valve opening period of the fuel injection valve 10, and also a desired quantity of supplementary air to be supplied to the engine 1, that is, a desired valve opening period of the first control valve 6, on the basis of the determined operating conditions of the engine and electrical loads on the engine, and then supplies driving pulses corresponding to the calculated values to the fuel injection valve 10 and the first control valve 6. The valve opening period of the first control valve 6 is determined by the ratio of the on-state period to the pulse separation of a pulse signal synchronous with the rotation of the engine 1, e.g. a pulse signal having each pulse generated at a predetermined crank angle of the engine 1.

The first control valve 6 has its solenoid 6*a* energized by each of its driving pulses to open the first air passage 8 for a period of time corresponding to its calculated valve opening period so that a quantity of supplementary air corresponding to the calculated valve opening value is supplied to the engine through the air passage 8 and the intake pipe 3.

The fuel injection valve 10 is energized by each of its driving pulses to open for a period of time corresponding to its calculated valve opening period value to inject fuel into the intake pipe 3 so as to achieve a desired air-fuel ratio of the mixture being supplied to the engine 1. As decribed in detail later, the valve opening period of the fuel injection valve 10 is increased or decreased by a predetermined amount a predetermined number of times in dependence on electrical load signals from the electrical devices 18, 19 and 20, on-state signal from the air conditioner, and the D-range signal from the automatic transmission, and preferably after the lapse of a predetermined period of time from the inputting of these signals to the ECU 9, thereby compensating for lag of the detection of the supplementary air quantity to ensure supply of an appropriate amount of fuel corresponding to a change in the supplementary air quantity to the engine 1.

The manner of fuel supply performed by the idling rpm feedback control system constructed as above will now be described in detail with reference to FIG. 1 already referred to and to FIGS. 2 and 3.

Figure 2:
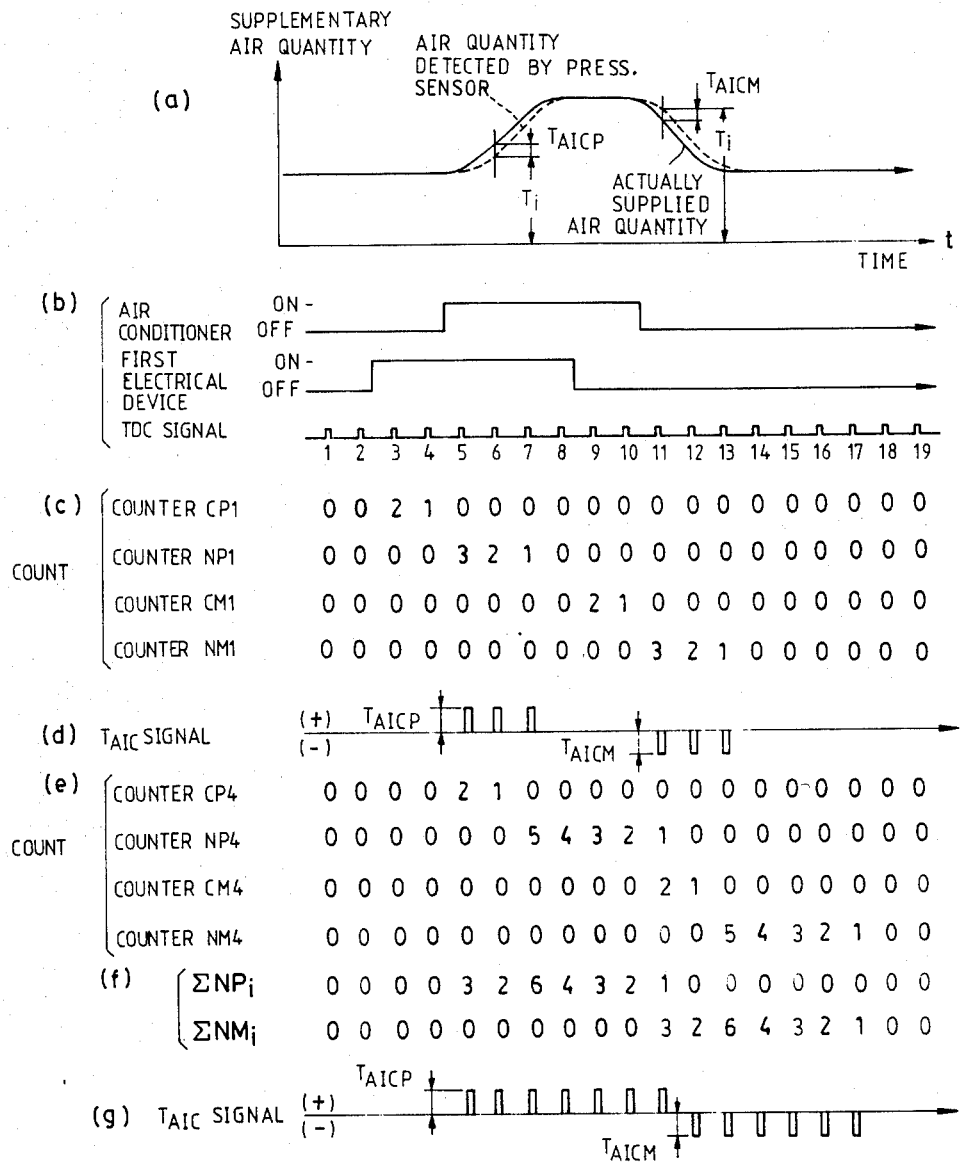
FIGS. 2*a* through 2*g* are a timing chart showing the fuel supply quantity control manner according to the invention.

Referring first to FIG. 2, there is illustrated a timing chart of a manner of varying the fuel quantity to be supplied to the engine 1 when there is a change in the operative states of the electrical devices, etc. during feedback control of the idling rpm. For the convenience of explanation, each TDC pulse is numbered in the sequence of generation as a TDC pulse 1, 2, 3 . . . and a first explanation given below is based upon the assumption that during the time between generation of the first TDC pulse 1 and generation of the nineteenth TDC pulse 19, the first electrical device 18 alone is switched on and off, and a second explanation on the assumption that during the time between the generations of the above two pulses, also the air conditioner is switched on and off in addition to the first electrical device 18, respectively.

Let it now be assumed that the first electrical device 18 is switched on at a time between a TDC pulse 2 and a TDC pulse 3 and switched off at a time between a TDC pulse 8 and a TDC pulse 9 ((b) of FIG. 2). The ECU 9 detects a signal indicative of the on-state of the first electrical device 18 immediately after the generation of the TDC pulse 3 and accordingly calculates a value of the valve opening period of the first control valve 6 corresponding to a quantity of supplementary air which is increased by a predetermined amount dependent upon the magnitude of the electrical load on the engine, applied by the first electrical device 18. The first control valve 6 is opened with a duty ratio corresponding to the calculated valve opening period DOUT. Similarly, even after generation of a TDC pulse 4, the ECU 9 continuously calculates the above same value of the valve opening period DOUT corresponding to the increased supplementary air quantity dependent upon the load of the first electrical device 18, and continuously causes opening of the first control valve 6 with a duty ratio corresponding to the calculated valve opening period DOUT until it is supplied with a signal indicative of the off-state of the same device. The increased supplementary air, which is determined and supplied immediately after the generation of the TDC pulse 3 as noted above, actually does not reach a cylinder of the engine 1 until after generation of a TDC pulse 5, as shown in (a) of FIG. 2. This suction delay time is determined by the passage configuration and size of the intake system of the engine, etc. and can be determined theoretically or experimentally. Further, the engine 1 is not supplied with a quantity of fuel which exactly corresponds to the above increased supplementary air until after generation of a TDC pulse 8. This is because the gradual increase of the intake air quantity during the time between the generation of the TDC pulse 5 and the generation of the TDC pulse 8 cannot be accurately detected mainly owing to the detection lag of the absolute pressure sensor 12 ((a) of FIG. 2). Therefore, while the increased air quantity is supplied to the engine 1 from a time immediately after generation of the TDC pulse 5 to a time immediately after generation of the TDC pulse 7, the increase of the fuel supply quantity cannot promptly follow the increase of the intake air quantity, resulting in a shortage in the fuel quantity. Consequently, the mixture supplied to the engine 1 becomes too lean, which can even cause engine stall, hunting of the engine rotation, etc.

Then, an off-state signal indicative of the switching-off of the first electrical device 18 at a time between generations of the TDC pulses 8 and 9, is detected immediately after generation of the TDC pulse 9. Since the switching-off of the first electrical device 18 means a reduction in the engine load, a value of the supplementary air quantity is calculated at a time immediately after generation of the TDC pulse 9, which is decreased from the preceding value by a predetermined amount corresponding to the electrical load of the first electrical device 18, and supplied to the engine 1 through the first control valve 6. Also in this event, the decreased supplementary air quantity is not actually supplied to the engine cylinder until after generation of a TDC pulse 11, due to the travel lag attributed to the passage configuration and size of the intake system, etc. Although the intake air quantity gradually decreases during the time between the generation of a TDC pulse 11 and the generation of the TDC pulse 14, the decreased fuel supply to the engine 1 cannot promptly follow the decrease of the intake air quantity due to the detection lag of the absolute pressure sensor 12, etc., causing supply of an excessive quantity of fuel to the engine and consequent excessive enrichment of the mixture, deteriorating the emission characteristics, and occurrence of hunting of the engine rotation, etc. during idling ((a) and (b) of FIG. 2).

According to the invention, the above-mentioned disadvantages can be eliminated in the following manner: After the supplementary air quantity supplied through the first control valve 6 has been increased immediately after the generation of the TDC pulse 3, and after the lapse of a period between the generation of the TDC pulse 3 and a time immediately before the generation of the TDC pulse 5 (hereinafter called "the fuel increase-delaying period"), the quantity of fuel supplied to the engine 1 is increased by a predetermined amount during the period between a time immediately after the generation of the TDC pulse 5 and a time immediately after the generation of the TDC pulse 7 (this period will be hereinafter called "the fuel increasing period"). On the other hand, after the supplementary air quantity has been decreased immediately after the generation of the TDC pulse 9, and after the lapse of a period between the generation of the TDC pulse 9 and a time immediately before the generation of the TDC pulse 11 (hereinafter called "the fuel decrease-delaying period"), the fuel supply quantity is decreased by a predetermined amount during the period between a time immediately after the generation of the TDC pulse 11 and a time immediately after the generation of the TDC pulse 13 (hereinafter called "fuel decreasing period").

The above manner of increase and decrease of fuel according to the invention will now be described in detail: Upon detection of an on-state signal from the first electrical device 18, a counter CP1 in the ECU 9 in FIG. 1 has its count set to a predetermined value, 2 for instance, which is determined by the passage configuration and size of the intake system, and other factors, and thenceafter the above newly set count is reduced by 1 upon inputting of each TDC pulse to the ECU 9 ((b) and (c) of FIG. 2). That is, the count in the counter CP1 occurring immediately after the generation of the TDC pulse 4 is set to 1, and the one occurring immediately after the generation of the TDC pulse 5 to 0, respectively. The time during which the count in the counter CP1 is other than 0 corresponds to the aforementioned fuel increase-delaying period, and when the count in the counter CP1 becomes zero, the above fuel increasing period starts. When the count in the counter CP1 becomes zero immediately after the generation of the TDC pulse 5, the count in another counter NP1 in the ECU 9 is set to a predetermined value, 3 for instance, which depends upon the magnitude of the load of the first electrical device 18 on the engine and corresponds to the aforementioned fuel increasing period. At the same time, the valve opening period TOUT of the fuel injection valve 10 is set to a value increased by a predetermined period TAICP corresponding to the detection error of the intake air quantity mainly attributed to the detection lag of the absolute pressure sensor 12. That is, the valve opening period TOUT of the fuel injection valve 10 is calculated by the following equation:

$$TOUT = Ti + TAIC \quad (1)$$

where Ti represents a value calculated on the basis of values of engine operation parameter signals from the throttle valve opening sensor 17, the absolute pressure sensor 12, the engine cooling water temperature sensor 13, the engine rpm sensor 14, etc. and TAIC is a constant which is set to TAICP during the above fuel increasing period.

The count in the counter NP1 is reduced by 1 upon inputting of each TDC pulse to the ECU 9, and as long as the count NP1 is other than 0, that is, during the period between the generations of the TDC pulses 5 and 7, the above predetermined value TAICP is added to the value Ti of the valve opening period TOUT of the fuel injection valve 10 upon generation of each of these TDC pulses, and a quantity of fuel corresponding to the calculated valve opening period TOUT is supplied to the engine 1 ((c) and (d) of FIG. 2). The count in the counter NP1 becomes zero immediately after the generation of the TDC pulse 8 ((c) of FIG. 2), and thereafter the predetermined value TAICP is no longer added to the value Ti of the valve opening period TOUT (The value TAIC is set to zero). Since by this time the delay time in detecting the changing intake air, i.e. the fuel increasing period has already lapsed, the intake air quantity can then be detected with accuracy ((a) (c) and (d) of FIG. 2), allowing the supply of a fuel quantity exactly corresponding to the supplementary air quantity.

Next, when the off-state signal from the first electrical device 18 is detected at a time immediately after generation of the TDC pulse 9, the valve opening period of the first control valve 6 is reduced by a predetermined amount dependent upon the magnitude of the load of the first electrical device 18, and the count in another counter CM1 in the ECU 9 is set to a predetermined value 2 which corresponds to the aforementioned fuel decrease-delaying period ((b) and (c) of FIG. 2). Then, this count of 2 is reduced by 1 each time each of the following TDC pulses is inputted to the ECU 9. As long as the count in the counter CM1 is other than 0, the above fuel decrease-delaying period still continues, during which neither increase or decrease of the fuel quantity is made by setting and holding the value TAIC at 0 in Equation (1)((c) and (d) of FIG. 2).

When the count in the counter CM1 becomes zero at a time immediately after the generation of the TDC pulse 11, the count in a counter NM1 in the ECU 9 is set to a predetermined value dependent upon the magnitude of the first electrical device 18 on the engine, 3 for instance, and the valve opening period TOUT of the fuel injection valve 10 is decreased by a predetermined value TAICM, that is, the valve opening period TOUT is calculated by the use of Equation (1) where the term TAIC is set to −TAICM. The fuel supply is effected on the basis of the resulting calculated value TOUT. The count in the counter NM1 is reduced by 1 upon inputting of each TDC pulse to the ECU 9, and the period during which the count in the counter NM1 is other than 0 means the above fuel decreasing period. During this period which lasts from a time immediately after the generation of the TDC pulse 11 to a time immediately after the generation of the TDC signal 13, the valve opening period TOUT is decreased by the predetermined value TAICM to supply a decreased quantity of fuel to the engine ((a), (c) and (d) of FIG. 2).

At a time immediately after generation of the TDC pulse 14, the count in the counter NM1 becomes zero, and thereafter the predetermined value TAICM is no more added to the basic value Ti of the valve opening period TOUT (the value TAIC in Equation (1) is set to zero). Since by this time the intake air detection delay time or the fuel decreasing period has already lapsed so that accurate detection of the intake air quantity is possible, to enable supply of an accurate quantity of fuel to the engine in a manner responsive to the supplementary air quantity ((a), (c) and (d) of FIG. 2).

Next, in addition to the switching-on and -off of the first electrical device 18, let it now be assumed that the air conditioner is switched on at a time between the generation of the TDC pulse 4 and the generation of the TDC pulse 5, and it is switched off at a time between the generation of the TDC pulse 10 and the generation of the TDC pulse 11 ((b) of FIG. 2). The same setting as that referred to previously is applied to the counts in the counters CP1, NP1, CM1 and NM1 related to the first electrical device 18 with respect to each of the TDC pulses ((c) of FIG. 2).

When the air conditioner is switched on, the switch 15 in FIG. 1 operatively connected thereto is closed to cause the supply of a signal indicative of the on-state of the air conditioner to the ECU 9, and simultaneously the second control valve 30 is opened to start supply of an increased quantity of supplementary air responsive to the load on the engine increased by the air conditioner 1. As previously described with respect to the first electrical device 18, this increased supplementary air quantity is actually sucked into an engine cylinder only after generation of the TDC pulse 7 with a delay of two TDC pulses after the opening of the second control valve 30 (immediately after the generation of the TDC pulse 5 in FIG. 2) in the example of (e) of FIG. 2, due to the suction lag attributed to the passage configuration and size of the intake system between the second control valve 30 and the engine cylinder, etc. Since there is no need of increasing the fuel supply quantity until after the period corresponding to this suction lag or the fuel increase-delaying period lapses, the count in a counter CP4 in the ECU 9 is set to a predetermined value 2 immediately after the generation of the TDC pulse 5, and thereafter this count is reduced by 1 at each of the following TDC pulses. When the count in the counter CP4 is reduced to zero, the count in a counter NP4 is set to a predetermined value, 5 for instance, which corresponds to the fuel increasing period dependent upon the load of the air conditioner. Upon inputting of each TDC pulse, this count is reduced by 1. When the air conditioner is switched off at a time between the generation of the TDC pulse 10 and the generation of the TDC pulse 11, the switch 15 is accordingly opened to cause the second control valve 30 to interrupt the supply of supplementary air to the engine 1. A substantial reduction in the supplementary air quantity occurs due to the above interruption of the supply of supplementary air only after generation of two TDC pulses, i.e. after generation of the TDC pulse 13. To count the period corresponding to this suction time lag, i.e. the fuel decrease-delaying period, the count in the counter CM4 in the ECU 9 is set to a predetermined value 2 at a time immediately after generation of the TDC pulse 11 ((b) and (e) of FIG. 2). Upon inputting of each of the following TDC pulses, the count in the counter CM4 is reduced by 1 and when the count is reduced to zero, the fuel decrease-delaying period terminates. To count the fuel decreasing period, the count in the counter NM4 in the ECU 9 is set to a predetermined value, 5 for instance, which is dependent upon the magnitude of the load of the air conditioner on the engine, followed by reducing the count by 1 at each of the following TDC pulses ((e) of FIG. 2).

In (f) of FIG. 2, the symbol ΣNPi represents a sum of the counts in the counter NP1 related to the first electrical device 18 and the counter NP4 related to the air conditioner occurring at each of the TDC pulses, and the symbol ΣNMi a sum of the counts in the counters NM1 and NM4 occurring at each of the TDC pulses.

As previously noted, the fuel increasing periods dependent upon the respective electrical loads of the first electrical device 18 and the air conditioner last as long as the counts in the respective counters NP1 and NP4 are other than zero. That is, the fuel increasing period dependent upon the combined load of the first electrical device 18 and the air conditioner lasts as long as the sum ΣNPi of the counts in the counters NP1 and NP4 is other than zero. Therefore, at each TDC pulse, this sum ΣNPi is determined, and as long as the determined value assumes a value other than zero, the valve opening period TOUT of the fuel injection valve 10 is calculated by the use of Equation (1) to increase the fuel quantity by the amount TAICP ((f) and (g) of FIG. 2).

Similarly, the sum ΣNMi occurring at each TDC pulse determines the fuel decreasing period dependent upon the combined load of the first electrical device 18 and the air conditioner. As long as the sum ΣNMi assumes a value other than zero, the valve opening period TOUT of the fuel injection valve 10 is calculated by the use of Equation (1) to decrease the fuel quantity by an amount corresponding to the predetermined period TAICM ((f) and (g) of FIG. 2).

In (f) of FIG. 2, the sum ΣNPi assumes a value of 1 and the sum ΣNMi a value of 3, respectively, at a time immediately after the generation of the TDC pulse 11. That is, the both sums assume values other than zero. On such an occasion, the fuel increase is preferentially effected to prevent engine stall, by setting the value TAIC to TAICP in Equation (1) to increase the fuel quantity by an amount corresponding to the predetermined period TAICP.

Further, it is noted in (f) of FIG. 2 that the counts in the counters NP1 and NP4 are both other than zero at a time immediately after the generation of the TDC pulse 7. Even in such event, the total increasing amount is just an amount corresponding to the single predetermined period TAICP. Likewise, the counts in the counters NM1 and NM4 are both other than zero at a time immediately after the generation of the TDC pulse 13, and also on such an occasion, the fuel decreasing amount is limited to an amount corresponding to the single predetermined period TAICM. This is because even if the supply quantity of supplementary air is increased as multiple loads are applied to the engine, the actual correcting amount required for compensation for the detection lag of the absolute pressure sensor 12 is nearly constant irrespective of the magnitude of the intake air quantity as shown in (a) of FIG. 2.

Although the foregoing explanations with reference to FIG. 2 are based upon the assumption that only the first electrical device 18 and the air conditioner are switched on and off, similar explanations may be applied also in the case where additional loads are applied to the engine 1, such as those of the second and third electrical devices 19 and 20, and the automatic transmission, description of which is therefore omitted.

FIG. 3 shows a flow chart of a routine for carrying out the manner of varying the fuel quantity according to the invention, described above, which is executed by the ECU 9.

When the present program is called upon inputting of each TDC pulse to the ECU 9 (the step 1 in FIG. 3), the loop formed by the steps 3 through 21 of the present program is repeatedly executed the same number of times as the number of kinds of loads on the engine. More specifically, in the embodiment, five kinds of loads are provided, which are applied by the first, second and third electrical devices 18, 19 and 20, the air conditioner, and the automatic transmission (hereinafter called "the first load" through "the fifth load", respectively, in the order mentioned), and therefore the loop formed by the steps 3 through 21 is repeated five times. To effect this repeated execution, the control variable i is set to 1 at the step 2. Next, it is determined at the step 3 whether or not the ith load, that is, the first load of the first electrical device 18 is in an on-state. If the device 18 is found to be in an on-state, it is further determined whether or not the device was also in an on-state at the time of generation of the preceding TDC pulse, at the step 4. If the answer to the question of the step 4 is negative or no, that is, the on-state of the first load occurred for the first time after the generation of the present TDC pulse, the count in the counter CP1 is set to a predetermined value C1 and simultaneously the count in the counter CM1 to zero, respectively, at the step 5. In FIG. 3, the predetermined value Ci is a constant which can assume a value of 0, and is provided for the supplementary air control valve related to an ith load and determined by the configuration and size of the passage of the intake system extending from the control valve to the engine cylinder, etc. The above predetermined value C1 is initially set to a value of 2, for instance, as explained with reference to FIG. 2. Then, the program proceeds to the step 6, where it is determined whether or not the value CP1 is equal to zero. If the answer is negative or no, that is, the fuel increase-delaying period is not yet terminated, the counts in the counters NP1 and NM1 are both set to zero, at the steps 7 and 8, and the program proceeds to the step 9.

If as a result of the determination of the step 4 it turns out that the first load was in an on-state upon generation of the preceding TDC pulse, the program proceeds to the step 10 where it is determined whether or not the count in the counter CP1 is equal to zero, that is, whether or not the fuel increase-delaying period has terminated. If the answer is negative or no, the count in the counter CP1 is reduced by 1, and the count in the counter CM1 is set to zero at the step 11, and then the program proceeds to the step 6. If the reduced or new count in the counter CP1 is not equal to zero, the program proceeds to the step 7, while if it is equal to zero, the count in the counter NP1 is set to a predetermined value NP1 which corresponds to a fuel increasing period dependent upon the first load, 3 for instance (the step 12), and the program proceeds to the aforementioned step 8. If at the step 10 the count in the counter CP1 is found to be zero, it is judged that the fuel increase-delaying period has terminated, that is, the program proceeds to the step 8.

When at the step 3 it is determined that the first load is not in an on-state, it is then determined at the step 13 whether or not the first load was in an on-state upon generation of the preceding TDC pulse. If the determination of the step 13 gives an affirmative answer or yes, that is, if there has occurred a transition in the state of the first load from on-state to off-state, the count in the counter CM1 is set to the predetermined value C1 (=2) and simultaneously the count in the counter CP1 is set to zero at the step 14. Next, the program proceeds to the step 15 where it is determined whether or not the count in the counter CM1 is equal to zero. If the answer is negative or no, that is, the fuel decrease-delaying period is still continuing, the counts in the counters NM1 and NP1 are both set to zero at the steps 16 and 17, followed by the program proceeding to the step 9. If the determination of the step 13 gives a negative answer, it is determined at the step 18 whether or not the count in the counter CM1 is equal to zero, that is, whether or not the fuel decrease-delaying period has terminated. If the answer is no, the count in the counter CM1 is reduced by 1 and simultaneously the count in the counter CP1 is set to zero at the step 19, and then the program proceeds to the step 15. If at the step 15 it is found that the count in the counter CM1, which has been reduced by 1 at the step 19, is not equal to zero, the determination of the step 16 is again effected, and if the count in the counter CM1 is equal to zero, the count in the counter NM1 is set to a predetermined value Nmi, 3 for instance, which corresponds to a fuel decreasing period dependent upon the first load, at the step 20, followed by setting of the value NPi at the step 17. Also, if at the aforementioned step 18 the count in the counter CM1 is found to be zero, it is judged that the fuel decrease-delaying period has terminated, that is, the step 17 is executed.

After the above settings of the counts in the counters CP1, CM1, NP1 and NM1 related to the first load have been finished, it is determined at the step 9 whether or not the control variable i is equal to 5, that is, whether or not all the settings of the counts in the counters related to the first through fifth loads have been finished, and if the answer is no, 1 is added to the present value of the variable i, at the step 21, followed by execution of the step 3 et seq. to effect setting of the counts in the counters related to the next load.

If the determination of the step 9 gives an affirmative answer, that is, the count settings related to all the loads have been finished, it is determined at the step 22 whether or not the sum ΣNPi of the counts in the counters NPi is larger than zero, and if the answer is negative, that is, if the sum ΣNPi is equal to zero, whether or not the other sum ΣNMi of the counts in the counters NMi is larger than zero is determined at the step 23. If the answer to the question of the step 22 is affirmative or yes, that is, the fuel increasing period is still continuing, the counts in all the counters NPi and all the counters NMi are each reduced by 1, at the steps 24 and 25, and simultaneously the term TAIC of Equation (1) for calculation of the valve opening period TOUT of the fuel injection valve 10 is set to the predetermined value TAICP, at the step 26, followed by termination of the program at the step 27.

If the determination of the step 23 gives an affirmative answer, that is, if the fuel decreasing period is still continuing, the counts in all the counters NMi are each reduced by 1 at the step 28, and the term TAIC of Equation (1) is set to the predetermined value −TAICM at the step 29, followed by termination of the program.

If the determination of the step 23 gives a negative answer, that is, if the sum ΣNMi is equal to zero, the term TAIC of Equation (1) is set to zero at the step 30, followed by termination of the program.

As noted above, the determination of the step 22 as to whether or not the sum ΣNPi is larger than zero is executed in advance of the determination of the step 23 as to wehther or not the sum ΣNMi is larger than zero. This means that if the sums ΣNPi and ΣNMi are not zero at the same time, the fuel increase is preferentially carried out, as previously stated with reference to (f) and (g) of FIG. 2.

Figure 4:
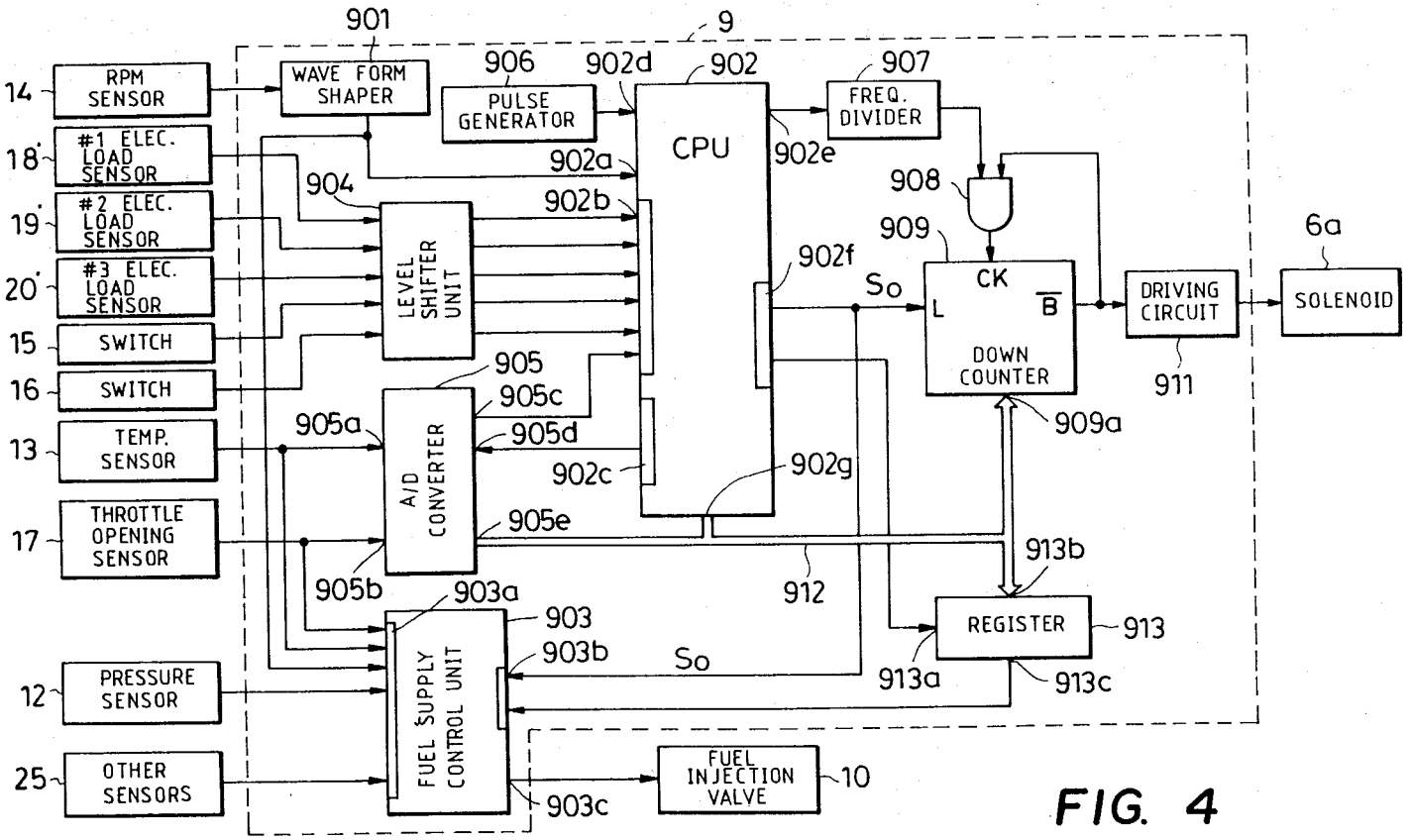
FIG. 4 is a circuit diagram illustrating an electrical circuit within the ECU in FIG. 1.

Next, the electrical circuit in the ECU 9 will now be described by referring to FIG. 4 which illustrates an embodiment thereof.

The engine rpm sensor 14 in FIG. 1 is connected to an input terminal 902*a* of a one chip CPU (hereinafter merely called "CPU") 902 by way of a waveform shaper 901, and also to a group of input terminals 903*a* of a fuel supply control unit 903, all provided within the ECU 9. Reference numerals 18', 19' and 20' designate sensor means for detecting the electrical loads of the electrical devices 18, 19 and 20 in FIG. 1, which are connected to respective ones of a group of further input terminals 902*b* of the CPU 902 by way of a level shifter unit 904 in the ECU 9. Further, the switches 15 and 16 are connected to the above input terminals 902*b* of the CPU 902 by way of the level shifter unit 904. The water temperature sensor 13 and the throttle valve opening sensor 17 are connected, respectively, to input terminals 905*a* and 905*b* of an analog-to-digital converter 905 and are also both connected to the input terminals 903*a* of the fuel supply control unit 903. The analog-to-digital converter 905 has an output terminal 905*c* connected to the input terminals 902*b* of the CPU 902 and a group of further input terminals 905*d* connected to a group of output terminals 902*c* of the CPU 902. A pulse generator 906 is connected to another input terminal 902*d* of the CPU 902 which in turn has an output terminal 902*e* connected to an AND circuit 908 at its one input terminal, by way of a frequency divider 907. The AND circuit 908 has its output connected to a clock pulse input terminal CK of a down counter 909. The AND circuit 908 has its other input terminal connected to a borrow output terminal $\overline{B}$ of the down counter 909 which terminal is further connected to the solenoid 6*a* of the first control valve 6 in FIG. 1, by way of a solenoid driving circuit 911. The CPU 902 has another group of output terminals 902*f*, one of which is connected to a load input terminal L of the down counter 909 and to another group of input terminals 903*b* of the fuel supply control unit 903, and another one of which is connected to an input terminal 913*a* of a register 913. The register 913 in turn has an output terminal 913*c* connected to the input terminal group 903*b* of the fuel supply control unit 903.

The analog-to-digital converter 905, the CPU 902, the down counter 909, and the register 913 are connected together by way of a data bus 912, respectively, at an output terminal 905*e*, an input and output terminal 902*g*, an input terminal 909*a*, and an input terminal 913*b*.

Connected to the input terminal group 903*a* of the fuel supply control unit 903 are the intake air pressure or absolute pressure sensor 12 and the other engine operation parameter sensors 25 such as an atmospheric pressure sensor, all appearing in FIG. 1. The fuel supply control unit 903 has an output terminal 903*c* connected to the fuel injection valve 10 in FIG. 10.

The electrical circuit of the ECU 9 constructed as above operates as follows: An output signal from the engine rpm sensor 14 is supplied to the CPU 902 and the fuel supply control unit 903 as an engine operation parameter signal indicative of engine rpm Ne as well as a TDC-synchronous signal indicative of a predetermined crank angle of the engine 1, after it is subjected to waveform shaping by the waveform shaper 901. The routine shown in FIG. 3 is executed in synchronism with this TDC-synchronous signal. The CPU 902 is responsive to each pulse of the TDC-synchronous signal to generate and supply a chip selecting signal, a channel selecting signal, an analog-to-digital conversion starting signal, etc. to the analog-to-digital converter 905, commanding the latter to convert analog signals such as the engine cooling water temperature signal and the throttle valve opening signal from the cooling water temperature sensor 13 and the throttle valve opening sensor 17 into corresponding digital signals. When the A/D converter 905 generates through its output terminal 905*e* a signal indicative of completion of the analog-to-digital conversion of one of the analog signal, the digitally converted signal indicative of engine cooling water temperature or throttle valve opening is supplied as a data signal to the CPU 902 via a data bus 912. Upon completion of supply of one of such digitally converted signals to the CPU 902, the same process as above is repeated to cause inputting of the other digitally converted signal to the CPU 902. Further, load-indicative signals from the electrical load sensor means 18', 19' and 20' and on-off state signals from the switches 15 and 16 are supplied to the CPU 902 after having their levels shifted to a predetermined level by the level shifter unit 904.

The CPU 902 operates on the input data signals indicative of engine rpm, engine cooling water temperature, throttle valve opening, and on- and off-states of the various loads to determine the operating conditions and loaded conditions of the engine and calculate values of the valve opening period DOUT of the first control valve 6 and determine the predetermined term values TAIC of Equation (1) as explained with reference to FIGS. 2 and 3, which are appropriate for the determined conditions. The valve opening period DOUT of the first control valve 6 is calculated so as to minimize the difference between actual engine rpm Ne detected by the engine rpm sensor 14 and desired idling rpm which is previously determined in dependence on the engine load.

Next, the CPU 902 supplies the calculated value pf the valve opening period DOUT of the first control valve 6 to the down counter 909 which is loaded with this calculated value upon each loading command signal from the CPU 902 being applied to its input terminal L. The CPU 902 also supplies the calculated predetermined value TAIC to the register 913 via the data bus 912, which is loaded with the above predetermined value TAIC upon a loading command signal from the CPU 902 being applied to its input terminal 913*a*.

On the other hand, a clock signal generated by the pulse generator 906 is used as a timing signal for the control operation carried out by the CPU 902, and at the same time it is subjected to frequency division by the frequency divider 907 into a suitable frequency and then supplied to one input terminal of the AND circuit 908.

When the down counter 909 is supplied with a starting command signal So from the CPU 902, it is loaded with the calculated value of the valve opening period DOUT of the first control valve 6 and at the same time generates a high level output of 1 at its borrow output terminal $\overline{B}$ and applies it to the other input terminal of the AND circuit 908 as well as the solenoid driving circuit 911. The solenoid driving circuit 911 energizes the solenoid 6*a* of the first control valve 6 to open same as long as it is supplied with the above high level output of 1 from the down counter 909, that is, with a duty ratio corresponding to the calculated value of the valve opening period DOUT.

As long as the AND circuit 908 has its other input terminal supplied with the above high level output of 1 from the down counter 909, it allows clock pulses supplied thereto through its one input terminal to be applied to the clock pulse input terminal CK of the down counter 909. The down counter 909 counts the clock pulses, and upon counting up to a number corresponding to the calculated value of the valve opening period DOUT of the first control valve 6 supplied thereto from the CPU 902, it generates a low level output of 0 through its borrow output terminal $\overline{B}$ to cause the solenoid driving circuit 911 to deenergize the solenoid 6*a* of the first control valve 6. At the same time, the above low level output of the down counter 909 is supplied to the AND circuit 908 as well, to interrupt the supply of further clock pulses to the down counter 909.

On the other hand, the fuel supply control unit 903 operates on engine operation parameter signals supplied from the engine rpm sensor 14, the engine water temperature sensor 13, the throttle valve opening sensor 17, the absolute pressure sensor 12, and the other engine operation parameter sensors 25, to calculate a desired value of the valve opening period Ti in accordance with Equation (1). The starting command signal So, which is supplied to the down counter 909, is also supplied to the fuel supply control unit 903 to cause inputting of the calculated value TAIC stored in the register 913 thereto. The above command signal So also causes the fuel supply control unit 903 to calculate a value of the valve opening period TOUT by adding the input value TAIC to the above calculated value Ti, to cause the fuel injection valve 10 to open for the calculated valve opening period.

Although the foregoing embodiment is directed to an internal combustion engine equipped with an automatic transmission, the invention may of course be applied to an internal combustion engine equipped with a manual transmission. Also, the electrical devices and mechanical equipments are not limited in number. Further, although in the embodiment, the absolute pressure sensor 12 has been used to detect the quantity of intake air being supplied to the engine, other type sensors may be used for the same purpose, such as a heating wire-type air flow meter.

What is claimed is:

1. In a method for controlling the idling rpm of an internal combustion engine including an intake passage, a throttle valve arranged in said intake passage, an air passage having one end communicating with said intake passage at a location downstream of said throttle valve and another end with the atmosphere, respectively, at least one control valve arranged in said air passage for metering the quantity of supplementary air being supplied to said engine through said air passage, and at least one equipment disposed to create load acting on said engine, said method comprising controlling in a feedback manner said control valve in response to the difference between actual engine rpm and desired idling rpm during idling of said engine, detecting the total quantity of intake air inclusive of the supplementary air at each predetermined rotational angle of said engine, and varying the quantity of fuel being supplied to said engine in response to the resulting detected value of the intake air quantity, so as to maintain the air-fuel ratio of an air-fuel mixture being supplied to said engine at a desired value, the improvement comprising the further steps of: (a) detecting the operative state of said equipment; and (b) upon detection of a transition in the operative state of said equipment, varying the supplementary air quantity through said control valve, in response to the magnitude of load on said engine, applied by said equipment, and varying the fuel quantity in a manner such that (i) when said equipment is rendered operative, the fuel quantity is increased by a first predetermined amount at each said predetermined rotational angle of said engine a first predetermined number of times, and (ii) when said equipment is rendered inoperative, the fuel quantity is decreased by a second predetermined amount at said each predetermined rotational angle of said engine a second predetermined number of times.

2. A method as claimed in claim 1, wherein said increase of the fuel quantity by said first predetermined amount is initiated after the lapse of a predetermined period of time from the start of said variation of the supplementary air quantity responsive to a transition in the operative state of said equipment.

3. A method as claimed in claim 1, wherein said decrease of the fuel quantity by said second predetermined amount is initiated after the lapse of a predetermined period of time from the start of said variation of the supplementary air quantity responsive to a transition in the operative state of said equipment.

4. A method as claimed in claim 1, wherein said first and second predetermined numbers of times are determined in dependence on the magnitude of load of said equipment acting on said engine.

5. In a method for controlling the idling rpm of an internal combustion engine including an intake passage, a throttle valve arranged in said intake passage, a plurality of air passages each having one end communicating with said intake passage at a location downstream of said throttle valve and another end with the atmosphere, respectively, a plurality of control valves disposed to adjust the quantity of supplementary air being supplied to said engine through respective ones of said air passages, and a plurality of equipments disposed to create respective loads acting on said engine, said method comprising controlling in a feedback manner at least one of said control valves in response to the difference between actual engine rpm and desired idling rpm during idling of said engine, detecting the total quantity of intake air inclusive of the supplementary air at each predetermined rotational angle of said engine, and varying the quantity of fuel being supplied to said engine in response to the resulting detected value of the intake air quantity, so as to maintain the air-fuel ratio of an air-fuel mixture being supplied to said engine at a desired value, the improvement comprising the further steps of: (a) detecting the operative state of each of said equipments; and (b) upon detection of a transition in the operative state of at least one of said equipments, varying the supplementary air quantity through at least one of said control valves corresponding to said at least one equipment, in response to the magnitude of load on said engine, applied by said at least one equipment, and varying the fuel quantity in a manner such that (i) when said at least one equipment is rendered operative, the fuel quantity is increased by a first predetermined amount at each said predetermined rotational angle of said engine a first predetermined number of times, and (ii) when said at least one equipment is rendered inoperative, the fuel quantity is decreased by a second predetermined amount at said each predetermined rotational angle of said engine a second predetermined number of times.

6. A method as claimed in claim 5, wherein said equipments comprise at least one of at least one electrical device providing an electrical load and at least one mechanical device driven by said engine and providing mechanical load.

7. A method as claimed in claim 5, wherein each of said control valves is controlled to increase and decrease the supplementary air quantity, respectively, in response to generation and extinction of a load provided by at least one of said equipments.

8. A method as claimed in claim 5, wherein said equipments comprise a plurality of electrical devices and a plurality of mechanical devices driven by said engine, said control valves comprising at least one first control valve disposed to be controlled in said feedback manner to meter the supplementary air quantity and to increase and decrease the supplementary air quantity, respectively, in response to generation and extinction of a load of each of said electrical devices, and a plurality of second control valves disposed in connection with respective ones of said mechanical devices, said second control valves each being responsive to generation and extinction of a load of a corresponding one of said mechanical devices for increasing and decreasing the supplementary air quantity, respectively.

9. A method as claimed in any of claims 5–7, wherein said increase or decrease of the fuel quantity by said first or second predetermined amount is initiated after the lapse of a predetermined period of time from the start of said variation of the supplementary air quantity responsive to a transition in the operative state of said equipment.

10. A method as claimed in any of claims 5–7, wherein if there is a concurrence of a state in which one of said control valves is supplying an increased quantity of supplementary air to said engine and a state in which another one of said control valves is supplying a decreased quantity of supplementary air to said engine so that there is a concurrence of contradictory requirements of increase of the fuel quantity by said first predetermined amount and decrease of same by said second predetermined amount, said increase of the fuel quantity by said first predetermined amount is preferentially carried out.

11. A method as claimed in any of claims 5–7, wherein while the supply of supplementary air is effected through said plurality of control valves at the same time, if there is an apparent requirement of a plurality of concurrent increases of the fuel quantity by amounts each amounting to said first predetermined amount, the total increasing fuel amount is limited to only said first predetermined amount, and if there is an apparent requirement of a plurality of concurrent decreases by amounts each amounting to said second predetermined amount, the total decreasing fuel amount is limited to only said second predetermined amount.

12. A method as claimed in any of claims 5–7, wherein said first and second predetermined numbers of times are determined in dependence on the magnitude of load of said equipments acting on said engine.

* * * * *